US011495392B2

(12) United States Patent
Jeong et al.

(10) Patent No.: US 11,495,392 B2
(45) Date of Patent: Nov. 8, 2022

(54) COIL ELECTRONIC COMPONENT

(71) Applicant: SAMSUNG ELECTRO-MECHANICS CO., LTD., Suwon-si (KR)

(72) Inventors: Ye Eun Jeong, Suwon-si (KR); Jin Ho Hong, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 675 days.

(21) Appl. No.: 16/567,532

(22) Filed: Sep. 11, 2019

(65) Prior Publication Data

US 2020/0185141 A1 Jun. 11, 2020

(30) Foreign Application Priority Data

Dec. 10, 2018 (KR) ..... 10-2018-0158396

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/04*** | (2006.01) |
| ***H01F 27/32*** | (2006.01) |

(52) U.S. Cl.

CPC ..... *H01F 27/2804* (2013.01); *H01F 27/29* (2013.01); *H01F 27/323* (2013.01); *H01F 41/041* (2013.01); *H01F 2027/2809* (2013.01)

(58) Field of Classification Search

CPC ..... H01F 27/2804
USPC ..... 336/200
See application file for complete search history.

(56) References Cited

U.S. PATENT DOCUMENTS

| | | | | |
|---|---|---|---|---|
| 10,304,614 | B2 * | 5/2019 | Yu | H02J 7/025 |
| 2015/0270053 | A1 * | 9/2015 | Cha | H01F 17/04 336/192 |
| 2016/0181002 | A1 * | 6/2016 | Kim | H01F 27/292 336/200 |
| 2016/0351321 | A1 * | 12/2016 | Lyoo | H01F 41/041 |
| 2017/0301453 | A1 * | 10/2017 | Jo | H01F 41/041 |
| 2019/0051446 | A1 * | 2/2019 | Park | H01F 27/32 |

FOREIGN PATENT DOCUMENTS

| | | |
|---|---|---|
| KR | 10-1740816 B1 | 5/2017 |
| KR | 10-1883046 B1 | 8/2018 |

* cited by examiner

*Primary Examiner* — Ronald Hinson
(74) *Attorney, Agent, or Firm* — Morgan, Lewis & Bockius LLP

(57) ABSTRACT

A coil electronic component includes a body including a laminate structure including a plurality of coil layers, and external electrodes disposed externally on the body. Each of the plurality of coil layers includes an insulating layer, a base pattern, and a coil pattern disposed on the base pattern, and a conductive via connecting the coil pattern to an adjacent coil layer, and the base pattern includes an intermetallic compound of Cu and Sn, and the coil pattern includes a Cu component.

16 Claims, 6 Drawing Sheets

COIL ELECTRONIC COMPONENT

CROSS-REFERENCE TO RELATED APPLICATION(S)

This application claims benefit of priority to Korean Patent Application No. 10-2018-0158396 filed on Dec. 10, 2018 in the Korean Intellectual Property Office, the disclosure of which is incorporated herein by reference in its entirety.

TECHNICAL FIELD

The present disclosure relates to a coil electronic component.

BACKGROUND

As electronic devices such as digital televisions, mobile phones, laptops, and the like, have been designed to have reduced sizes, a coil electronic component applied to such electronic devices has been required to have a reduced size. To meet such demand, a large amount of studies into developing various types of coil-type or thin-film type coil electronic components have been conducted.

An important consideration in developing a coil electronic component having a reduced size is to implement the same properties as before after reducing a size of a coil electronic component. To this end, it may be necessary to increase a content of a magnetic material filling a core. However, there may be a limitation in increasing a content of the magnetic material due to strength of an inductor body, changes in frequency properties caused by insulating property, and for other reasons.

When a coil is implemented by layering a plurality of coils, physical and electrical connectivity between coil layers may be significant. In other words, when cohesion stability of a coil pattern, a conductive via, and the like, is low, reliability of a coil electronic component may degrade.

SUMMARY

An aspect of the present disclosure is to provide a coil electronic component in which connection reliability between a coil pattern and a conductive via may improve such that structural stability and electrical properties of the coil electronic component may improve.

According to an aspect of the present disclosure, a coil electronic component is provided, the coil electronic component including a body including a laminate structure including a plurality of coil layers, and external electrodes disposed externally on the body. Each of the plurality of coil layers includes an insulating layer, a base pattern, and a coil pattern disposed on the base pattern, and a conductive via connecting the coil pattern to an adjacent coil layer of the plurality of coil layers, and the base pattern includes an intermetallic compound of Cu and Sn, and the coil pattern includes a Cu component.

The intermetallic compound may have a composition of $Cu_3Sn$.

The intermetallic compound may further include a composition of $Cu_6Sn_5$.

The base pattern and the coil pattern may have the same width.

A thickness of the coil pattern may be greater than a thickness of the base pattern.

A thickness of the base pattern may be 3 μm or less.

A lower surface of the conductive via may be in contact with an upper surface of the coil pattern, and an upper surface of the conductive via may be connected to a base pattern of an adjacent coil layer of the plurality of coil layers.

The conductive via may include a Cu component.

The conductive via may not substantially include an intermetallic compound of Cu and Sn.

A thickness of a portion of the intermetallic compound disposed between the coil pattern and a conductive via of an adjacent coil layer of the plurality of coil layers, and a thickness of another portion of the intermetallic compound disposed between the coil pattern and an insulating layer of the adjacent coil layer, may be substantially the same.

A width of the intermetallic compound may be greater than a width of a conductive via of an adjacent coil layer of the plurality of coil layers.

The base pattern, the coil pattern, and the conductive via may be buried in the insulating layer.

A lower surface of the base pattern and an upper surface of the conductive via may be exposed from the insulating layer.

The insulating layer may be made of a photosensitive insulating material.

The coil electronic component may further include cover layers disposed on and below the laminated structure, respectively, and made of a material different from the insulating layer.

The intermetallic compound may directly connect the coil pattern and a conductive layer of an adjacent coil layer of the plurality of coil layers to each other.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
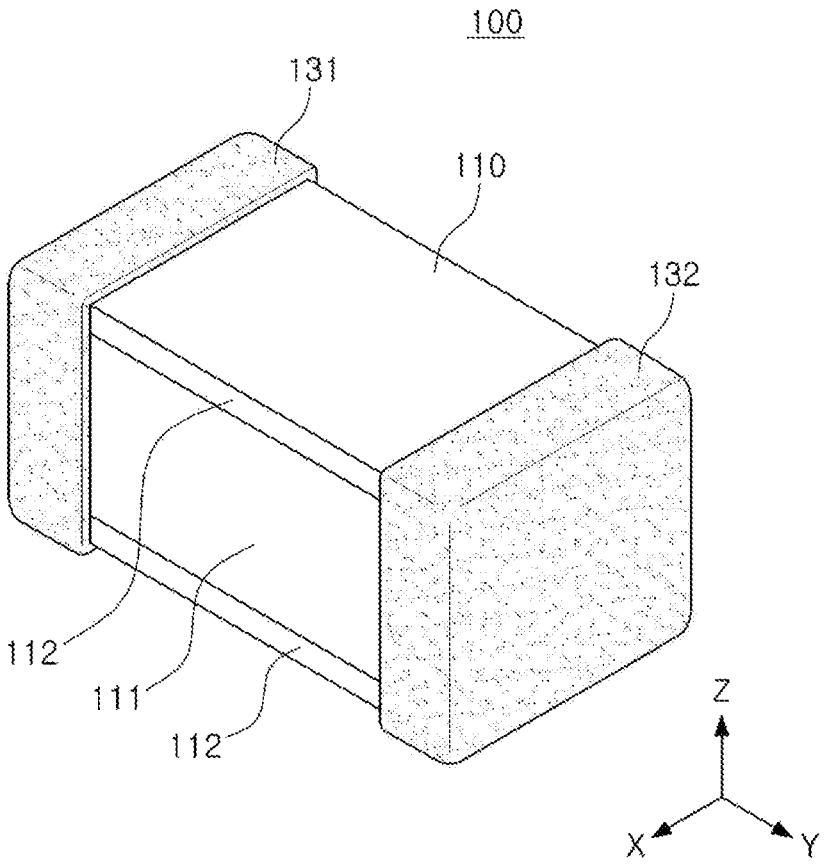
FIG. 1 is a perspective diagram illustrating a coil electronic component according to an example embodiment of the present disclosure.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art. Accordingly, shapes and sizes of the elements in the drawings can be exaggerated for clear description. Also, elements having the same function within the scope of the same concept represented in the drawing of each exemplary embodiment will be described using the same reference numeral.

Figure 2:
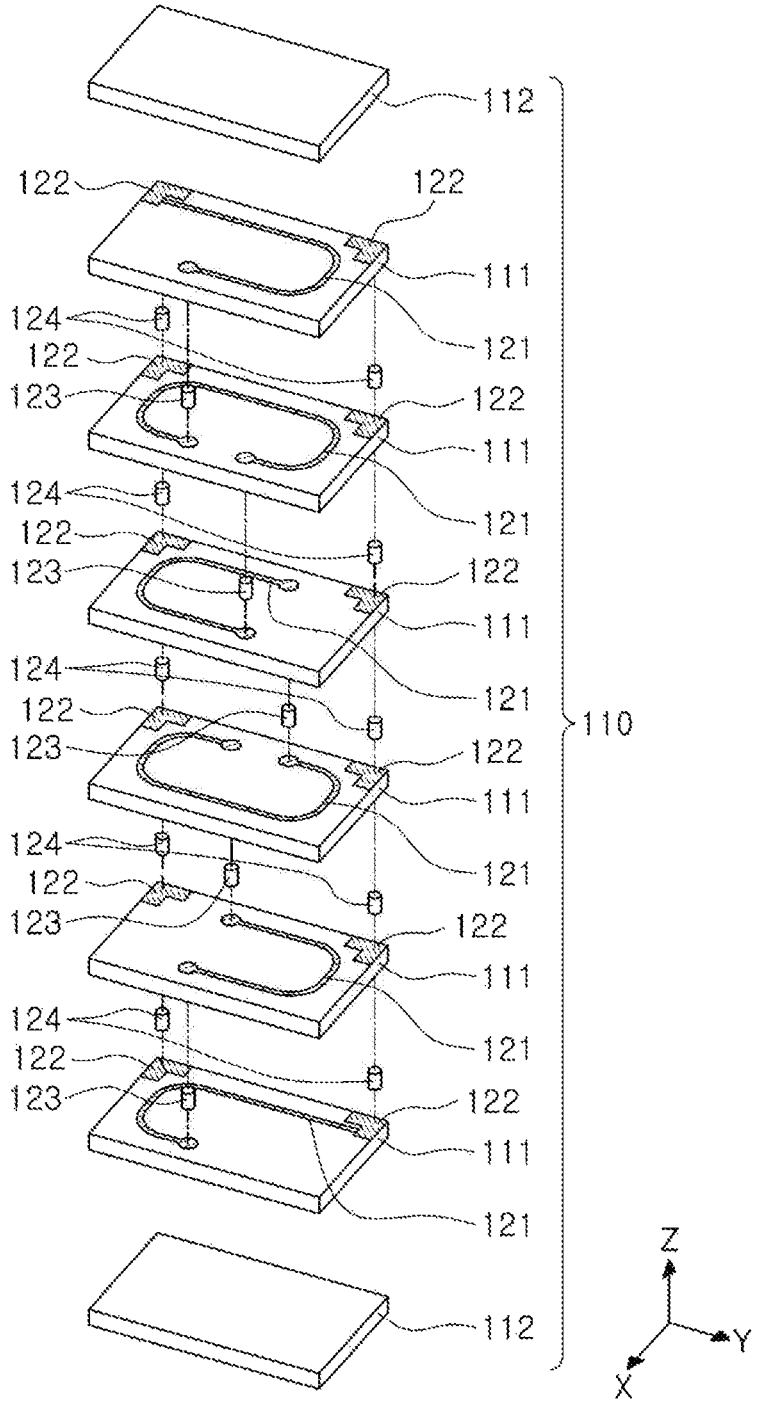
FIG. 2 is an exploded perspective diagram illustrating a body employable in the example embodiment illustrated in FIG. 1.
Figure 3:
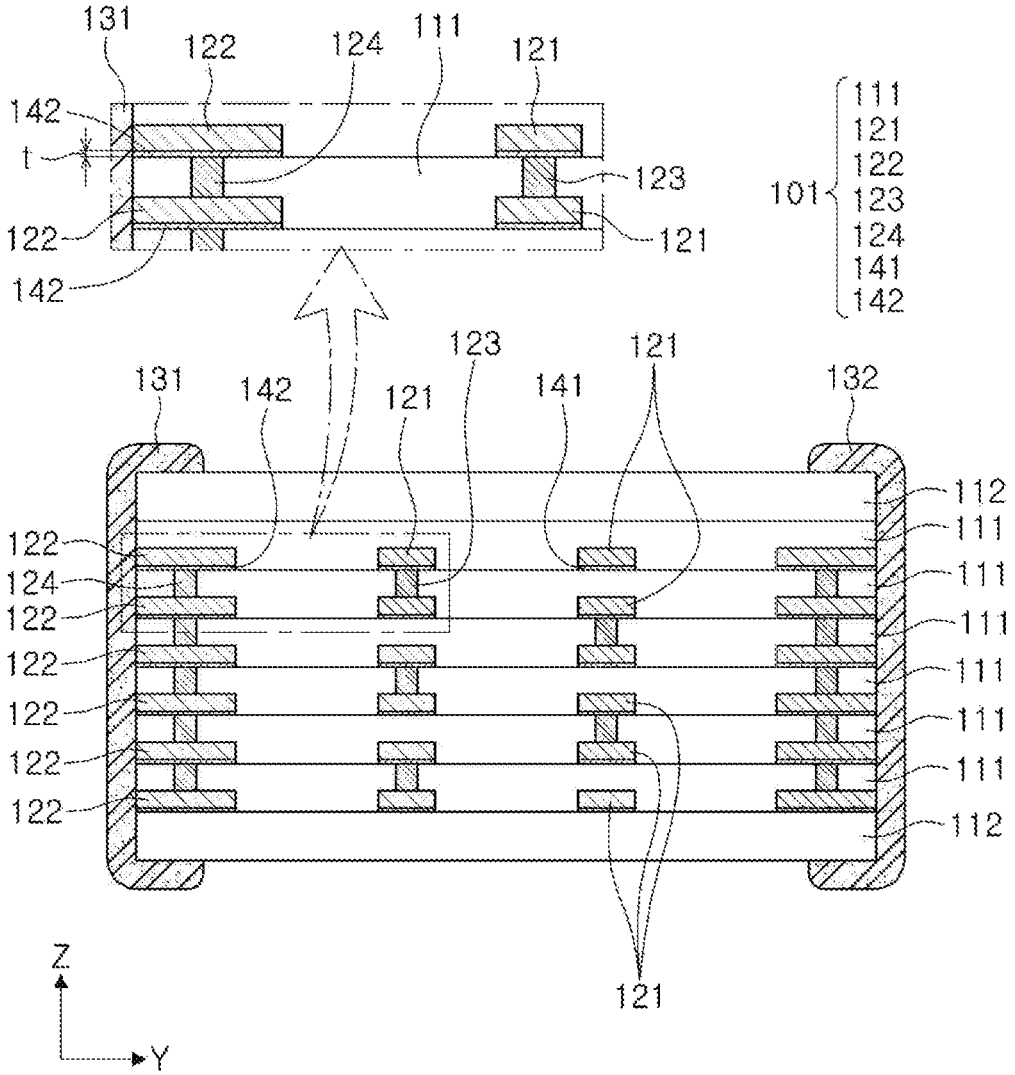
FIG. 3 is a cross-sectional diagram illustrating a coil electronic component according to the example embodiment illustrated in FIG. 1.

FIG. 1 is a perspective diagram illustrating a coil electronic component according to an example embodiment. FIG. 2 is an exploded perspective diagram illustrating a body employable in the example embodiment illustrated in FIG. 1. FIG. 3 is a cross-sectional diagram illustrating a coil electronic component according to the example embodiment illustrated in FIG. 1, illustrating an example configuration in which a conductive via and a connection pattern are cut to be exposed.

Referring to FIGS. 1, 2, and 3, a coil electronic component 100 may include a body 110 and external electrodes 131 and 132 disposed externally on the body 110, and the body 110 may include a laminate structure including a plurality of coil layers 101. The body 110 may further include a cover layer 112. The cover layer 112 may have stiffness greater than stiffness of an insulating layer 111 forming the coil layer 101 such that structural stability of the body 110 may improve. The cover layer 112 may be disposed on an upper portion and a lower portion of the coil layer 101 as illustrated in FIG. 3. However, an example embodiment thereof is not limited thereto. The cover layer 112 may only be disposed on one of the upper portion and the lower portion of the coil layer 101.

A pair of the external electrodes 131 and 132 may be provided, and the external electrodes 131 and 132 may be disposed in positions symmetrical to each other in a length direction in the body 110. The external electrodes 131 and 132 may be connected to the coil pattern 111 of the body 110, and a connection pattern 122 may be provided between the external electrodes 131 and 132. As an example of the external electrodes 131 and 132, an outermost layer may be configured as a tin (Sn) plated layer, and a nickel (Ni) plated layer may be formed below the tin (Sn) plated layer.

In the description below, a structure of the body 110 will be described in greater detail.

A plurality of the coil layers 101 may be provided and may be layered in one direction, and each of the coil layers 101 may include the insulating layer 111, the base pattern 141, a coil pattern 121, and a conductive via 123. Accordingly, the coil pattern 121 of the coil layer 101 may have a coil form in the layering direction.

The insulating layer 111 may be formed of a material forming the body 110 of the coil electronic component 100. For example, a resin, a ceramic, ferrite, and the like, may be used. In the example embodiment, the insulating layer 111 may be formed using a photosensitive material, and accordingly, a fine pattern may be implemented through a photolithography process. By forming the insulating layer 111 using a photosensitive insulating material, the conductive via 123, the coil pattern 121, and other components, may be formed in fine form, such that a size of the coil electronic component 100 may be reduced, and a function of the coil electronic component 100 may improve. To this end, the insulating layer 111 may include a photosensitive organic material or a photosensitive resin. In addition to the above-described material, the insulating layer 111 may further include an inorganic material including, but not limited to, one or more of $SiO_2$, $Al_2O_3$, $BaSO_4$, and Talc, as a filler component. As illustrated in the diagram, the base pattern 141, the coil pattern 121, and the conductive via 123 may be buried in the insulating layer 111, and a lower surface of the base pattern 141 and an upper surface of the conductive via 123 may be configured to be exposed from the insulating layer 111.

The base pattern 141 may be disposed on a lower portion of the coil pattern 121, and a lower surface of the base pattern 141 may be connected to the conductive via 123 as illustrated in the diagram. The base pattern 141 may also be disposed on a lower portion of a connection pattern 122, and a reference numeral of the base pattern disposed on a lower portion of the connection pattern 122 is indicated as 142 in the diagram. In the description below, the base pattern 141 disposed on a lower portion of the coil pattern 121 will be described, and the description of the base pattern 141 may also be applied to the base pattern 142 disposed on a lower portion of the connection pattern 122 unless otherwise indicated.

In the example embodiment, the base pattern 141 may include an intermetallic compound of Cu and Sn, and the intermetallic compound may have a composition of $Cu_3Sn$. By forming the base pattern 141 including the intermetallic compound in a lower portion of the coil pattern 121, structural and electrical connectivity with the conductive via 123 may improve, and voids formed in the insulating layer 111 around the conductive via 123 may be reduced. In a general coil electronic component, a conductive via and an adhesive layer combined to the conductive via may be used to connect coil patterns, and generally, the conducive via may be formed of Cu, and an adhesive layer may be formed of Sn. When a Cu layer and an Sn layer are combined to each other, a Cu—Sn intermetallic compound may be formed. An example composition of the Cu—Sn intermetallic compound may be $Cu_6Sn_5$, $Cu_3Sn$, and the like. As an example, in an early stage, $Cu_6Sn_5$ may be formed, and $Cu_6Sn_5$ may turn into $Cu_3Sn$ such that a remaining Sn component may be formed as $Cu_6Sn_5$. A density of $Cu_6Sn_5$ and a density of $Cu_3Sn$ may be 8.3 g/cm$^3$ and 8.9 g/cm$^3$ levels, respectively, which may be higher than a density of Sn of 7.3 g/cm$^3$ level. Accordingly, a Cu—Sn intermetallic compound may be formed around a conductive via such that a volume may decrease, and a void may be formed in the insulating layer 111.

In the example embodiment, the base pattern 141 in a lower portion of the coil pattern 121 may be formed of a Cu—Sn intermetallic compound to prevent an additional intermetallic compound from being formed or to reduce the amount of an intermetallic compound when the base pattern 141 is in contact with another conductive via 123 of another coil layer 101. In other words, when the base pattern 141 is formed of an intermetallic compound in advance, an additional Cu—Sn intermetallic compound may not be formed, even when the base pattern 141 is in contact with another conductive via 123 of another coil layer 101 in a process of matching and layering the coil layers 101. Accordingly, the coil pattern 121 may be configured to have a thickness greater than a thickness of the base pattern 141. Since no additional intermetallic compound is formed, a thickness of a portion of the intermetallic compound (or the base pattern 141) disposed between the coil pattern 121 and a conductive via 123 of an adjacent coil layer 101, and a thickness of another portion of the intermetallic compound (or the base pattern 141) disposed between the coil pattern 121 and an insulating layer 111 of the adjacent coil layer 101, may be substantially the same. The term, "substantially," reflects consideration of recognizable process errors which may occur during manufacturing or measurement. A thickness t of the base pattern 141 may be determined in consideration of a connection function with the conductive via 123 and easiness in formation of an intermetallic compound. For example, the thickness t of the base pattern 141 may be 3 μm or less, and when the thickness t is greater than 3 μm, an Sn layer may not sufficiently turn into a Cu—Sn intermetallic compound.

The coil pattern 121 may be disposed on the base patterns 141 and 142, and in this case, the base pattern 141 and the coil pattern 121 may have the same width. The coil pattern 121 may be obtained by patterning a metal having high conductivity in coil form. For example, a tenting method using a Cu foil etching process, a semi-additive process (SAP) using a copper plating process, a modified semi-additive process (MASP), and the like, may be used. In the example embodiment, as a metal material for forming the coil pattern 121, copper (Cu), silver (Ag), palladium (Pd), aluminum (Al), nickel (Ni), titanium (Ti), gold (Au), platinum (Pt), or combinations thereof, may be used. For example, the coil pattern 121 may be configured as a Cu layer, and the base pattern 141 may be formed as an Sn layer, may be combined with a Cu component, and may include a Cu—Sn intermetallic compound in a subsequent process.

As illustrated in FIG. 3, the base pattern 141 may be configured to be partially buried in the insulating layer 111 and one surface of the base pattern 141 may be exposed, and the configuration may be obtained in a process of separately manufacturing the coil layers 101. The configuration in which one surface of the base pattern 141 is exposed may indicate that the one surface of the base pattern 141 may be exposed from the insulating layer 111 disposed on the same level as the level of the base pattern 141. Also, by using a process of separately preparing the coil layers 101 and layering the coil layers 101, the body 110 may have an asymmetrical form, asymmetrical upwardly and downwardly. Thus, as illustrated in FIG. 3, in the body 110, the coil layer 101, the connection pattern 122, and the like, included in the body 110, may be disposed in asymmetrical form, asymmetrical upwardly and downwardly, with reference to a central plane.

The conductive via 123 may connect the coil pattern 121 to an adjacent coil layer 101. In other words, the conductive via 123 may be configured to connect the coil patterns 121 disposed on different layers, and may include a Cu component. Also, differently from a general coil electronic component, the conductive via 123 may not substantially include an intermetallic compound of Cu and Sn. As described above, in a general coil electronic component, a conductive via may be formed using a Cu layer, and the conductive via and a coil pattern may be adhered to each other using an adhesive layer including an Sn component. Accordingly, the conductive via may include a Cu—Sn intermetallic compound. In the example embodiment, a bonding structure of the coil layers 101 may be implemented by forming the base pattern 141 using a Cu—Sn intermetallic compound and not interposing an Sn adhesive layer between the conductive via 123 and the base pattern 141, thereby significantly reducing formation of a Cu—Sn intermetallic compound in the conductive via 123. A volume may be reduced in the process of forming a Cu—Sn intermetallic compound, but in the example embodiment, a void formed in the insulating layer 111 may be reduced as the reduction of a volume of the conductive via 123 significantly decreases, thereby improving interlayer connection reliability of the coil layers 101.

In the example embodiment, the coil layer 101 may include the connection pattern 122 formed on corners of the insulating layer 111 and connected to the external electrodes 131 and 132. By including the connection pattern 122, the coil pattern 121 may be stably coupled to the external electrodes 131 and 132, and electrical properties may improve. Similarly to the coil pattern 121, the connection pattern 122 may be formed of a material such as Cu, or the like, and as illustrated in FIG. 2, the connection pattern 122 may have an L-shaped form. By including the L-shaped connection pattern 122, cohesion force with the external electrodes 131 and 132 may improve.

The coil layer 101 may further include a conductive via 124 penetrating the insulating layer 111 and connected to the connection pattern 122 to connect the connection patterns 122 disposed on different levels. In this case, the conductive via 124 may have a structure similar to or the same as the structure of the conductive via 123 for connecting the coil patterns 121.

As for the connection structure of the connection pattern 122 and the coil pattern 121, in an uppermost coil layer and a lowermost coil layer of the plurality of coil layers 101, the coil pattern 121 may be connected to the connection pattern 122 as illustrated in FIG. 2. In the other coil layers (four coil layers disposed in the middle) other than the uppermost coil layer and the lowermost coil layer among the plurality of coil layers 101, the coil pattern 121 may not be connected to the connection pattern 122.

In the example embodiment, a pair of the connection patterns 122 may be formed in each of the coil layers 101 and may be connected to a pair of the external electrodes 131 and 132, but an example embodiment thereof is not limited thereto. The number of the connection patterns 122 may be varied. For example, the connection patterns 122 may be formed on all four corners of the insulating layer 111. Also, a position in which the connection pattern 122 is disposed may be varied, differently from the example illustrated in FIG. 2. For example, a pair of the connection patterns 122 may be formed on two corners of the insulating layer 111 opposing each other in a diagonal direction.

In the description below, a method of manufacturing a coil electronic component having the above-described structure will be described with reference to FIGS. 4 to 8.

Figure 4:
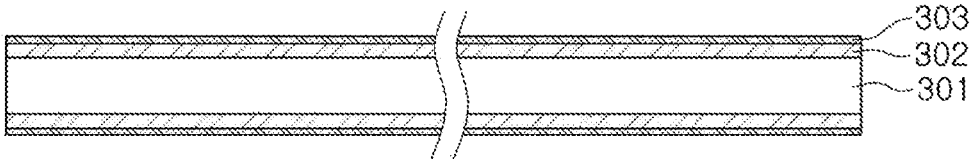
FIGS. 4 to 8 are diagrams illustrating a method of manufacturing a coil electronic component according to an example embodiment of the present disclosure.
Figure 5:
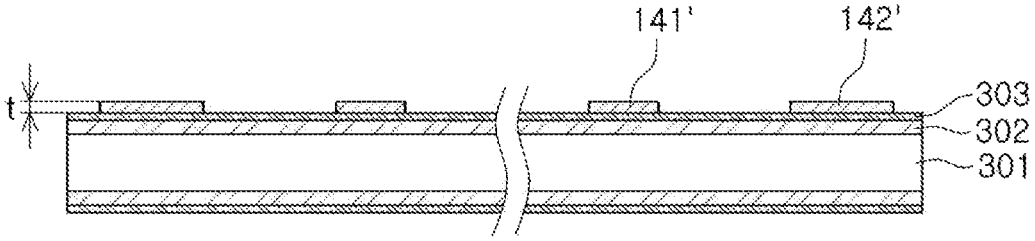

The coil electronic component described in the aforementioned example embodiment may be manufactured by layering coil layers. As an example, as illustrated in FIGS. 4 to 7, an individual coil layer 101 including an insulating layer 111, a base pattern 141, a coil pattern 121, a conductive via 123, and the like, may be manufactured. For example, as illustrated in FIGS. 4 and 5, a carrier layer 301 may be arranged, and base patterns 141' and 142' may be formed on a surface of the carrier layer 301. The carrier layer 301 may be formed of a thermosetting resin, and copper foil layers 302 and 303 may be formed on a surface of the carrier layer 301. Accordingly, the carrier layer 301 may be provided in a form of a copper clad laminate. The copper foil layers 302 and 303 may perform a function of easily separating a seed for forming the coil pattern 121 or the carrier layer 301 in a subsequent process. In example embodiments, the copper foil layers 302 and 303 may not be provided.

Figure 6:
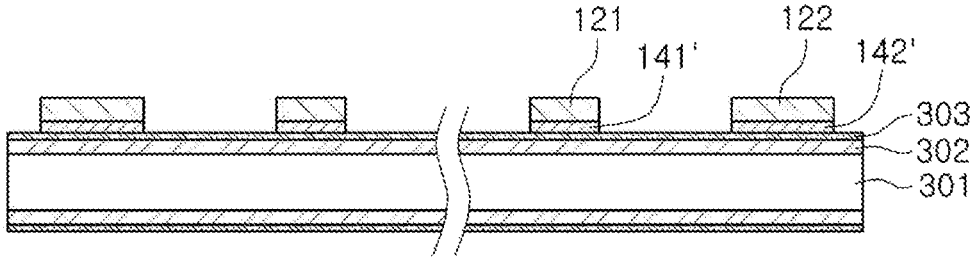

The base patterns 141' and 142' may include an Sn component. For example, the base patterns 141' and 142' may be formed of Sn layers. The base patterns 141' and 142' may be formed of an Sn layer through a plating process. The base patterns 141' and 142' may turn into a Cu—Sn intermetallic compound during or before a matching process of the coil layers 101, and accordingly, cohesion force with the coil pattern 121 and the conductive via 123 may improve. To allow the Sn layer to sufficiently turn into a Cu—Sn intermetallic compound, a thickness t of each of the base patterns 141' and 142' may be configured to be 3 μm or less. As illustrated in FIG. 6, the coil pattern 121 may be formed on the base patterns 141' and 142'. In this case, the connection pattern 122 may also be formed in the process of forming the coil pattern 121. The base patterns 141' and 142', the coil pattern 121, and the connection pattern 122 may be obtained by layering mask layers on the copper foil layer 303, patterning the mask layers, and plating a metal material. The mask layers may be removed. The base patterns 141' and 142', the coil pattern 121, and the connection pattern 122 may be formed on both of an upper surface and a lower surface of the carrier layer 301, and accordingly, two coil layers 101 may be obtained through a single process.

Figure 7:
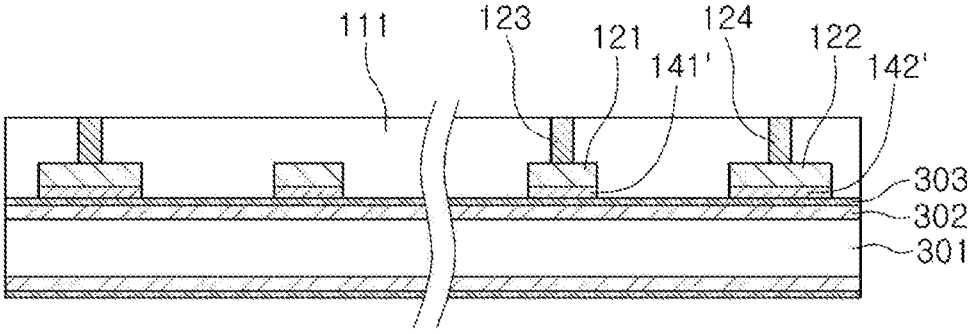

As illustrated in FIG. 7, an insulating layer 111 may be formed to cover the base patterns 141' and 142', the coil pattern 121, and the connection pattern 122, and the insulating layer 111 may be applied to both of an upper surface and a lower surface of the carrier layer 301. As described above, the insulating layer 111 may be formed using a photosensitive insulating material, and a photosensitive insulating material may be coated using a vacuum laminator, for example. In this case, the insulating layer 111 may have a thickness of 10 to 80 μm approximately, and depending on desired purposes, the insulating layer 111 may include a metal or a ceramic filler. Hardness of the insulating layer 111 may be adjusted based on an amount of a photosensitive material included in the insulating layer 111, and two or more types of a thermosetting material and a photosensitive material may be mixed. A conductive via 123 may be formed to be connected to the coil pattern 121. To this end, a through-hole may be formed by exposure and development of the insulating layer 111 formed of a photosensitive insulating material using UV, and the like, and a Cu layer, as the conductive via 123, may be formed by a plating process.

Figure 8:
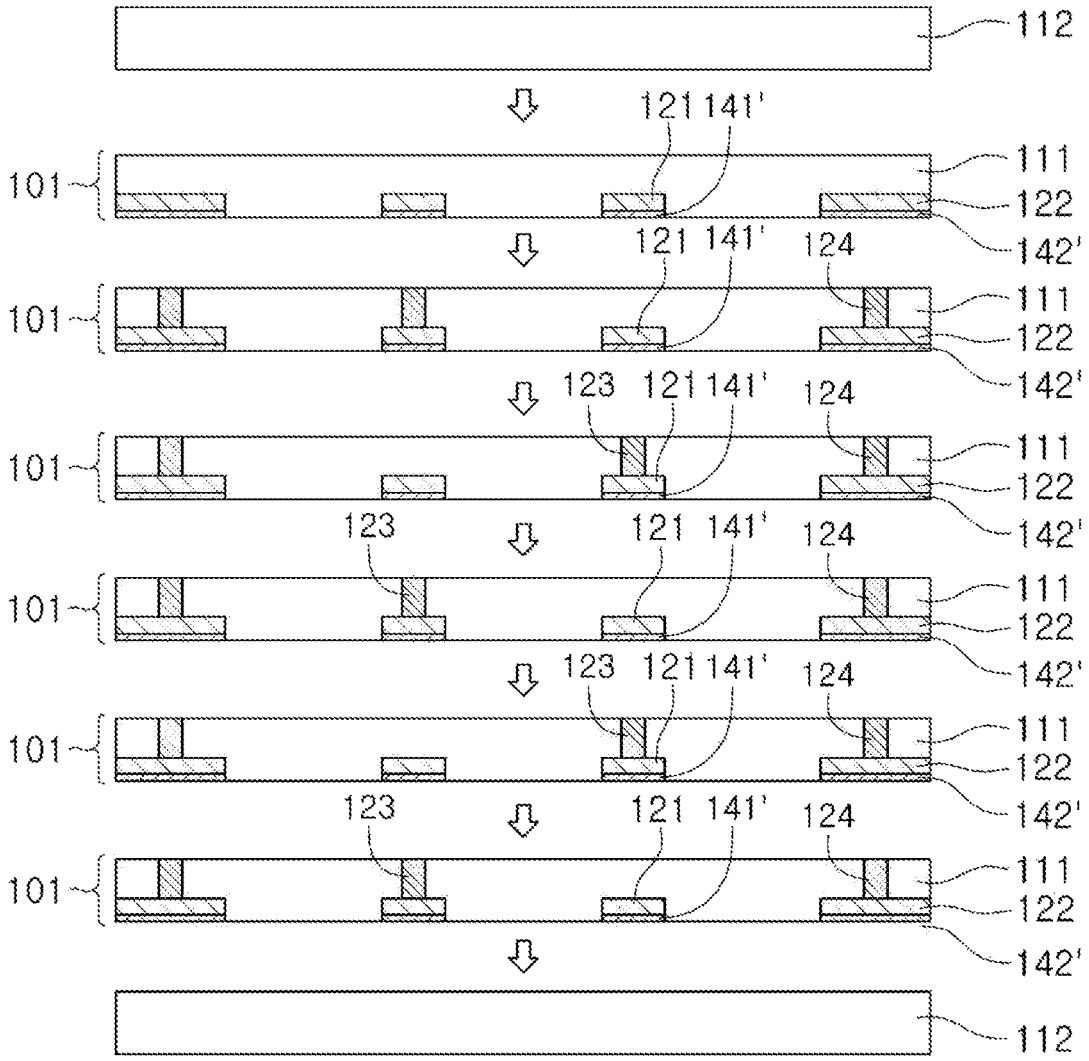

As illustrated in FIG. 8, an individual coil layer 101 may be obtained by separating the carrier layer 301 from the coil layer 101, and a plurality of the coil layers 101 may be prepared and layered. In this case, by including the copper foil layer 302, the carrier layer 301 may be easily separated from the coil layer 101. The copper foil layer 303 remaining in a lower portion of the coil layer 101 may be removed by applying an etching process widely used in the respective technical field.

Through the above-described processes, a desired number of individual coil layers 101 may be manufactured, and shapes of the base patterns 141' and 142', the coil pattern 121, the connection pattern 122, and the like, included in each of the coil layers 101 may be different. A cover layer 112 may be manufactured separately from the coil layers 101, and the cover layer 112 may include a large amount of ceramic filler as compared to an insulating resin. In one example, the cover layer 112 and the insulating layer 111 may be made of different materials. The coil layers 101 and the cover layer 112 may be layered, and by applying heat and pressure, a laminate structure may be obtained. In the layering process, the base patterns 141' and 142' may be changed and may include a Cu—Sn intermetallic compound. Also, before the layering process, the base patterns 141' and 142' may be configured to turn into a Cu—Sn intermetallic compound layer in advance.

In the body obtained through the above-described processes, cohesion between the layers may be stably implemented without going through a sintering process. The external electrodes 131 and 132 may be formed externally on the body, and the above-described coil electronic component 100 may be implemented. The external electrodes 131 and 132 may be formed by coating a conductive paste or by a plating process, or the like.

In the example embodiment, as the body may be formed by layering the coil layers 101 manufactured in advance, the number of processes and process time may be reduced as compared to a method of sequentially layering the layers, which may reduce process costs. Also, by using the manufacturing method described in the aforementioned example embodiment, a size, electrical properties, and the like, of the coil electronic component 100 may be effectively implemented by adjusting the number of the coil layers 101 and a thickness of each of the coil layers 101. In the example embodiment, the coil layers 101 may be layered at once, but an example embodiment thereof is not limited thereto. Depending on the number of the coil layers 101, the coil layers 101 may be divided and the divided coil layers 101 may be layered two or more times. In this case, as illustrated in the diagram, lower surfaces of the base patterns 141' and 142', a lower surface of the insulating layer 111, an upper surface of the conductive via 123, and an upper surface of the insulating layer 111 may be coplanar with one another, and accordingly, a level difference between the layers formed in the layering process may be significantly reduced.

Also, as described in the aforementioned example embodiment, as the base patterns 141 and 142 are in a Cu—Sn intermetallic compound state before the base patterns 141 and 142 are combined with the conductive via 123 of another coil layer 101, the formation of an intermetallic compound between the base patterns 141 and 142 and the conductive via 123 of another coil layer 101 may be significantly reduced. Accordingly, the reduction of a volume caused when the conductive via 123 turns into an intermetallic compound may decrease, and voids may be reduced in the insulating layer 111.

According to the aforementioned example embodiments, in the coil electronic component, connection reliability between the coil pattern and the conductive via may improve such that structural stability and electrical properties of the coil electronic component may improve.

While the exemplary embodiments have been shown and described above, it will be apparent to those skilled in the art that modifications and variations could be made without departing from the scope of the present invention as defined by the appended claims.

What is claimed is:

1. A coil electronic component, comprising:

a body including a laminate structure including a plurality of coil layers; and external electrodes disposed externally on the body, wherein each of the plurality of coil layers includes an insulating layer, a base pattern, and a coil pattern disposed on the base pattern, and a conductive via connecting the coil pattern to an adjacent coil layer of the plurality of coil layers, and wherein the base pattern includes an intermetallic compound of Cu and Sn, and the coil pattern includes a Cu component.

2. The coil electronic component of claim 1, wherein the intermetallic compound has a composition of $Cu_3Sn$.

3. The coil electronic component of claim 2, wherein the intermetallic compound further includes a composition of $Cu_6Sn_5$.

4. The coil electronic component of claim 1, wherein the base pattern and the coil pattern have the same width.

5. The coil electronic component of claim 1, wherein a thickness of the coil pattern is greater than a thickness of the base pattern.

6. The coil electronic component of claim 1, wherein a thickness of the base pattern is 3 μm or less.

7. The coil electronic component of claim 1, wherein a lower surface of the conductive via is in contact with an upper surface of the coil pattern, and an upper surface of the conductive via is connected to a base pattern of an adjacent coil layer of the plurality of coil layers.

8. The coil electronic component of claim 1, wherein the conductive via includes a Cu component.

9. The coil electronic component of claim 1, wherein the conductive via does not substantially include an intermetallic compound of Cu and Sn.

10. The coil electronic component of claim 1, wherein a thickness of a portion of the intermetallic compound disposed between the coil pattern and a conductive via of an adjacent coil layer of the plurality of coil layers, and a thickness of another portion of the intermetallic compound disposed between the coil pattern and an insulating layer of the adjacent coil layer, are substantially the same.

11. The coil electronic component of claim 1, wherein a width of the intermetallic compound is greater than a width of a conductive via of an adjacent coil layer of the plurality of coil layers.

12. The coil electronic component of claim 1, wherein the base pattern, the coil pattern, and the conductive via are buried in the insulating layer.

13. The coil electronic component of claim 12, wherein a lower surface of the base pattern and an upper surface of the conductive via are exposed from the insulating layer.

14. The coil electronic component of claim 1, wherein the insulating layer is made of a photosensitive insulating material.

15. The coil electronic component of claim 1, further comprising cover layers disposed on and below the laminated structure, respectively, and made of a material different from the insulating layer.

16. The coil electronic component of claim 1, wherein the intermetallic compound directly connects the coil pattern and a conductive layer of an adjacent coil layer of the plurality of coil layers to each other.

* * * * *